United States Patent [19]

Dragone

[11] 4,439,748

[45] Mar. 27, 1984

[54] CORRUGATED WAVEGUIDE OR FEEDHORN ASSEMBLED FROM GROOVED PIECES

[75] Inventor: Corrado Dragone, Little Silver, N.J.

[73] Assignee: Bell Telephone Laboratories, Incorporated, Murray Hill, N.J.

[21] Appl. No.: 392,613

[22] Filed: Jun. 28, 1982

[51] Int. Cl.[3] ..... H01P 3/123

[52] U.S. Cl. ..... 333/239; 343/786; 29/600

[58] Field of Search ..... 333/239, 251, 241, 208, 333/157; 29/600; 343/786, 772

[56] References Cited

U.S. PATENT DOCUMENTS

| | | | |
|---|---|---|---|
| 2,943,280 | 6/1960 | Brill | 333/208 |
| 3,046,507 | 7/1962 | Jones, Jr. | 333/239 |
| 3,274,603 | 9/1966 | Kay | 343/786 X |
| 3,618,106 | 11/1969 | Bryant | 343/772 |
| 3,949,406 | 4/1976 | Yvard | 343/786 |
| 3,974,467 | 8/1976 | Tobita et al. | 333/241 |
| 4,047,133 | 9/1977 | Merle | 333/241 |
| 4,255,753 | 3/1981 | Lovick, Jr. | 343/786 |

OTHER PUBLICATIONS

Baldwin, R. et al., "A Rectangular Corrugated Feed Horn", *IEEE Transactions on Antenna and Propagation*, vol. AP23, No. 6, (Nov. 1975), pp. 819–817.

Dragone, C. "Characteristics of a Broadband Microwave Corrugated Feed: A Comparison Between Theory and Experiment", *BSTJ*, vol. 56, No. 6, (Jul./Aug 1977), pp. 869–888.

Jones, Jr. H., "Horn Design Saves Weight Without Performance Loss", *Microwaves*, vol. 12, No. 10, (Oct. 1973), pp. 72–76.

*Primary Examiner*—Paul L. Gensler
*Assistant Examiner*—Benny Lee
*Attorney, Agent, or Firm*—Erwin W. Pfeifle

[57] ABSTRACT

The present invention relates to a rectangular corrugated waveguide or feedhorn wherein a plurality of adjacent grooves of a predetermined depth and cross-section are formed, preferably by numerical machining, in a major exposed surface of each of four plates of an electrically conductive material. The four plates are then secured together to form a rectangular corrugated passage therebetween where the ends of the line of grooves in one plate substantially meet and are aligned with the ends of corresponding grooves in another plate to form a solid line of electrically conductive material at the corners of the passage.

11 Claims, 5 Drawing Figures

CORRUGATED WAVEGUIDE OR FEEDHORN ASSEMBLED FROM GROOVED PIECES

BACKGROUND OF THE INVENTION

1. Field of the Invention

The present invention relates to a technique for providing a corrugated rectangular waveguide or feedhorn and, more particularly, to a technique for providing a corrugated rectangular guide where the corrugated rectangular waveguide or horn is fabricated by forming, preferably by numerical machining, grooves of a predetermined depth and cross-section in a line into four electrically conductive plates and then arranging the plates to provide a hollow corrugated rectangular waveguide or horn where the edges of the grooves in each plate essentially meet the edges of the grooves in an adjacent plate.

2. Description of the Prior Art

Corrugated waveguide and horn radiators have been used for a wide range of applications in microwave antennas because of their favorable electrical properties. For the most part these corrugated waveguide and horns have been of a circular or conical configuration because it is easier to form the grooves or corrugations with such cross-section. Rectangular waveguides or horns, however, are preferred for certain applications.

Rectangular corrugated flexible waveguides have been manufactured from a smooth-wall metal tube which is corrugated in a predetermined manner to form the rectangular cross-section. In this regard see, for example, U.S. Pat. Nos. 3,974,467 issued to S. Tobita et al on Aug. 10, 1976 and 4,047,133 issued to M. Merle on Sept. 6, 1977.

Various techniques have been used to provide the corrugations within a horn or waveguide. For example, as disclosed in U.S. Pat. No. 3,949,406 issued to M. Yvard on Apr. 6, 1976 a horn comprises an outside sheet metal support on the inside of which is installed, one beside another, a great number of rings having a shape such that two adjacent rings form a corrugation. Such technique could also be applied to a rectangular guide or horn. A second technique is shown in U.S. Pat. No. 4,255,753 issued to E. Lovick, Jr. on Mar. 10, 1981 where a continuous wire coil is disposed on the inside of a metal support of a circular or rectangular cross-section.

As disclosed in U.S. Pat. No. 3,618,106 issued to G. H. Bryant on Nov. 2, 1971 which relates to antenna feed systems comprising corrugated waveguides or horns of square or rectangular cross-section, it has been found that undesirable modes which have the effect, among other things, of limiting bandwidth are set up in the waveguide or horn due to the varying depths of the grooves at the corners of the square or rectangular guide. Bryant solves this problem by inserting corner pieces in each corner of each corrugation, which method is impractical and inaccurate for production purposes.

The problem remaining in the prior art is to provide a technique for providing rectangular corrugated waveguide or horns which eliminate the varying corrugation depth at the corner and is adaptable for mass production purposes.

SUMMARY OF THE INVENTION

The foregoing problem has been solved in accordance with the present invention which relates to a technique for providing a corrugated rectangular waveguide or feedhorn and, more particularly, to a technique for providing a corrugated rectangular guide where the corrugated rectangular waveguide or horn is fabricated by forming, preferably by numerical machining, grooves of a predetermined depth and cross-section in a line into four electrically conductive plates and then arranging the plates to provide a hollow corrugated rectangular waveguide or horn where the edges of the grooves in each plate essentially meet the edges of the grooves in an adjacent plate.

It is an aspect of the present invention to provide a technique for providing a corrugated rectangular waveguide or feedhorn which avoids the varying corrugation depth at the corners of the corrugations and is adaptable to mass-production of such waveguides.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
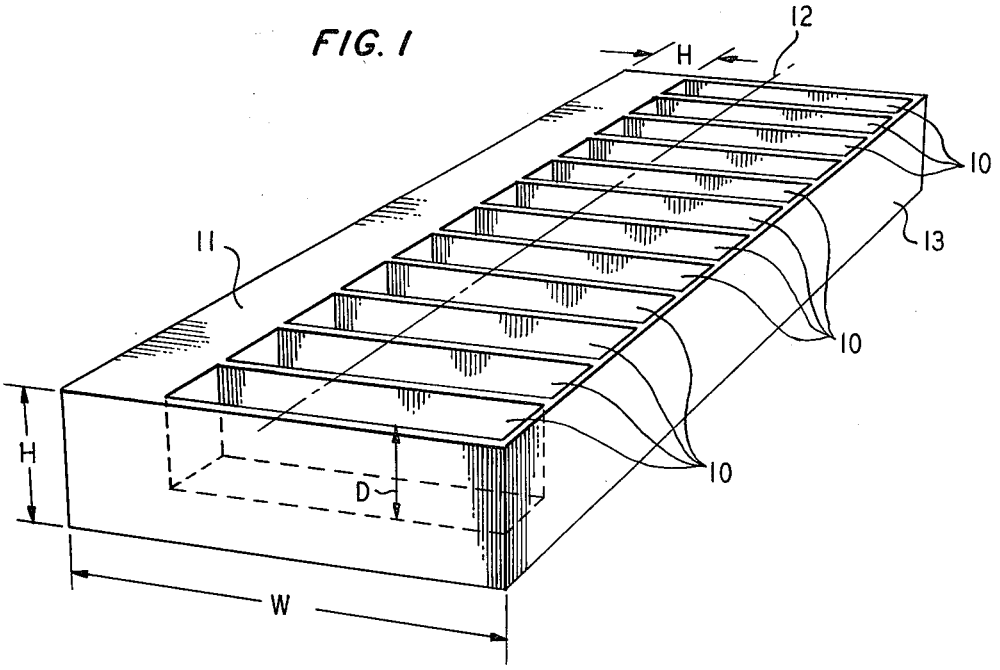
FIG. 1 is a view in perspective of a rectangular block of electrically conductive material including grooves which are machined therein where the block is used to form one wall of a rectangular waveguide section in accordance with the present invention.

In accordance with the present invention, a rectangular corrugated waveguide or horn is constructed by separately forming each of the four wall sections and then combining the four sections to form a rectangular waveguide or horn which does not include a varying depth groove at each of the corners and thereby avoids the formation of spurious modes. FIG. 1 illustrates an exemplary wall section for forming a rectangular corrugated waveguide section.

In FIG. 1, a plurality of grooves 10 of a predetermined depth, D, and cross-section are formed in a rectangular block 11 of an electrically conductive material by, for example, a machining process. The preferred technique for forming the grooves 10 is by the use of a numerical machining process which (a) allows precise automated formation of the grooves in a reasonably fast manner, and (b) is advantageous for the mass production machining of many similar wall sections.

In the exemplary wall section of FIG. 1, a block 11 having an end cross-sectional width W and height H and a longitudinal axis 12 has a line of correspondingly shaped grooves 10 cut therein normal to longitudinal axis 12 of block 11. The grooves 10 begin very close to one edge of the major exposed surface of block 11 and extend thereacross to a distance W-H from the opposite edge of the major exposed surface of block 11. It is clear that the distance W-H corresponds to the thickness H of a block 11 to permit easy formation of the rectangular corrugated waveguide section as is shown in FIG. 2.

Figure 2:
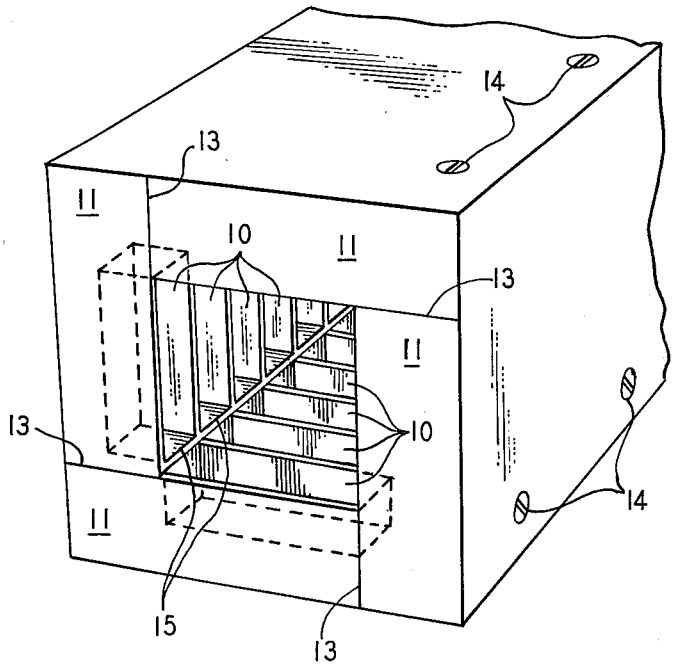
FIG. 2 is a view in perspective of a section of a rectangular waveguide formed from four blocks shown in FIG. 1.
Figure 3:
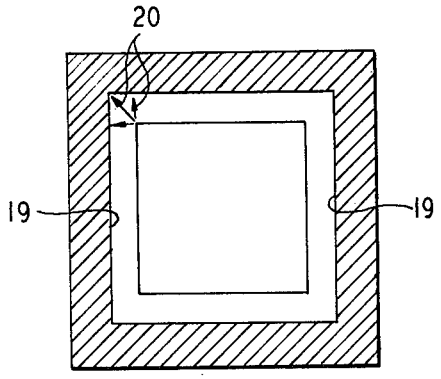
FIG. 3 (PRIOR ART)
FIG. 3 is a front view in cross-section of a square waveguide section found in the prior art which has varying depth grooves at the corners thereof.

In the arrangement of FIG. 2, for a square corrugated waveguide section in accordance with the present invention, four of the blocks 11 with grooves 10 therein, as shown in FIG. 1, are disposed in relation to each other such that the edge 13 of a first block 11 which is very close to the ends of grooves 10 is secured by, for example, screws 14 to the section of the major exposed surface of a second block 11 in the ungrooved area opposite edge 13. Additionally, corresponding grooves 10 in the first and second blocks 11 are also aligned before securing such that the corners 15 between corresponding grooves at mated blocks 11 are stepped to form an edge along the aperture of the waveguide section to avoid a varying depth groove at the corners as shown by arrows 20 in the typical prior art square corrugated waveguide groove 19 as shown in cross-section in FIG. 3. It is to be understood that any rectangular corrugated waveguide section can be formed by using a first pair of correspondingly dimensioned blocks 11 with a width $W_1$ and a second pair of correspondingly dimensioned blocks 11 with a width $W_2$ which is different from $W_1$.

Figure 4:
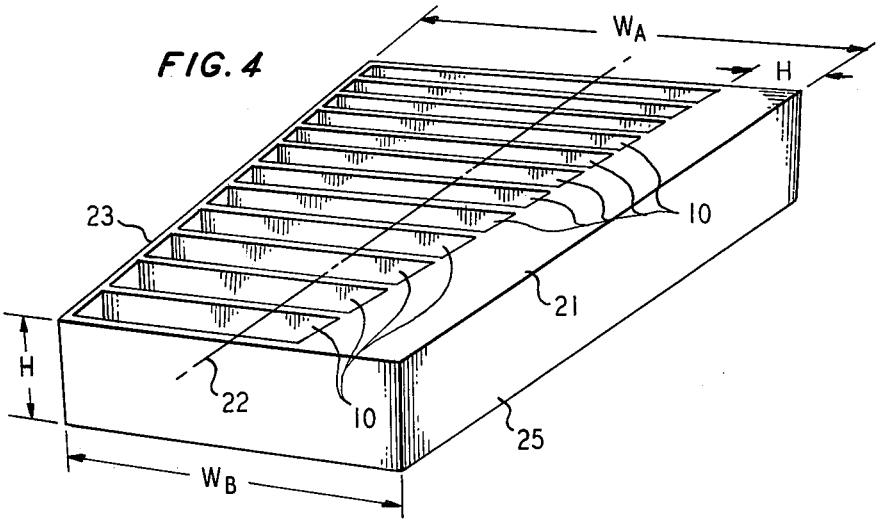
FIG. 4 is a view in perspective of a tapered block of electrically conductive material including grooves of increasing length along the longitudinal axis of the block for forming one wall of a rectangular corrugated horn in accordance with the present invention.

FIG. 4 illustrates a view in perspective of a block of electrically conductive material 21 which is used for forming one wall of a symmetrically tapered horn in accordance with the present invention. Block 21 of FIG. 4 is shown as comprising a thickness H, similar to block 11 of FIG. 1, and the major exposed surface of block 21 is symmetrically tapered down along longitudinal axis 22 from one end with a width $W_A$, which will form the aperture of the horn when combined with three other blocks 21, to a second end with a width $W_B$ which will form the throat of the horn when combined with three other blocks 21. Grooves 10 with a predetermined depth, D, are formed by, for example, a numerical machining process normal to the longitudinal axis 22 of block 21 starting very close to a first tapered edge 23 of block 21. The grooves 10 comprise decreasing lengths across block 21 as they progress from the first end, of width $W_A$, to the second end, of width $W_B$, in order to leave a section of width H where no grooves are located on the exposed major surface of block 21. This section of width H is provided to permit edge 23 of a second block 21 to be mounted thereon to form the symmetrically tapered horn in the manner shown in FIG. 2 for the rectangular corrugated waveguide section.

Figure 5:
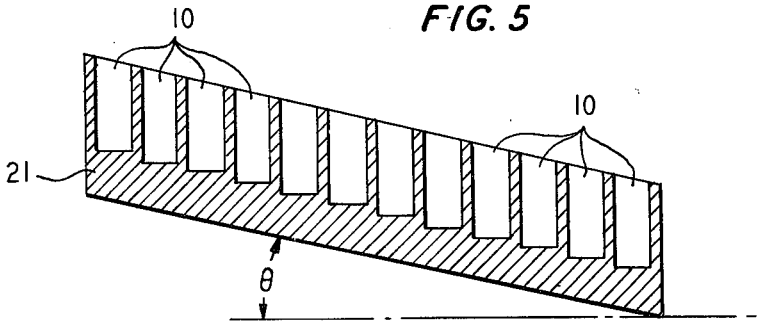
FIG. 5 is a view in cross-section along the longitudinal axis of the block of FIG. 4.

Grooves 10 are preferably formed normal to the longitudinal axis of a horn produced by four blocks 21 shown in FIG. 4 in the manner described hereinbefore for forming the waveguide section of FIG. 2 with four blocks 11 of FIG. 1. Such grooves can be formed as shown in FIG. 5 by tilting the surface of block 21 to be grooved at a predetermined angle $\theta$ to the longitudinal axis 22 of block 21. The angle $\theta$ corresponds to the angle of taper of, for example, edge 23 of block 21 with respect to the longitudinal axis 22. Once the block 21 is oriented as shown in FIG. 5, a cutting tool can be applied normal to horizontal plane to provide grooves at an angle $\theta$ to the major exposed surface of block 21. It is to be understood that grooves 10 as shown in FIG. 5 are presented here for exemplary purposes only and not for purposes of limitation since it is also possible to provide grooves 10 which are, for example, normal to the exposed major surface of block 21 rather than at an angle $\theta$ thereto.

What is claimed is:

1. A method of fabricating a rectangular corrugated waveguide or feedhorn section, the method comprising the steps of:

(a) forming a plurality of grooves of a predetermined depth and cross-section disposed in a line in a direction along a minor cross-sectional axis of the grooves in a major exposed surface of each of four separate plates comprising an electrically conductive material; and (b) disposing the four plates formed in step (a) relative to each other for forming a hollow corrugated rectangular guide section with a predetermined sized passage therethrough such that the ends of the grooves in each of the plates both substantially meet and are essentially aligned with ends of the grooves in a separate other plate of the four plates at each of the corners of the hollow guide section to provide a line of electrically conductive material at each of the corners of the passage through the guide section.

2. The method according to claim 1 wherein in performing step (a), performing the step of:

(c) forming the plurality of grooves such that a first end of each of the grooves is disposed adjacent a first edge of the major exposed surface of each plate parallel to a longitudinal axis of a plate, the grooves extending across the major exposed surface such that a second end of the grooves is within the thickness of a plate from a second edge of the major exposed surface opposite the first edge.

3. The method according to claim 2 wherein in performing step (b), performing the steps of:

(d) engaging a side surface bordering on the first edge of the major exposed surface of each plate with the major exposed surface of a separate one of the four plates in the area between the second edge of the major exposed surface and the second end of the grooves in said major exposed surface; and (e) securing the four plates to each other.

4. The method according to claim 1, 2 or 3 wherein in performing step (a) using plates including a major exposed surface which is rectangular in shape for forming a waveguide section.

5. The method according to claim 1, 2 or 3 wherein in performing step (a) using plates including a flat frustum shaped major exposed surface for forming a feedhorn section.

6. The method according to claim 5 wherein the method comprises the further step of:

(f) in performing step (a), forming the grooves across the major exposed surface of each plate at a predetermined angle to said major exposed surface such that the grooves will be disposed normal to a longitudinal axis of the feedhorn section when the four plates are disposed together in accordance with step (b).

7. A rectangular corrugated waveguide or feedhorn section comprising:

four plates comprising an electrically conductive material, each plate including a plurality of grooves of a predetermined depth and cross-section disposed in a line in a direction along a minor cross-sectional axis of the grooves in a major exposed surface of each of the four plates, the four plates being disposed relative to each other to form a hollow corrugated rectangular guie section with a predetermined sized passage therethrough such that the ends of the grooves in each of the plates both substantially meet and are essentially aligned with the ends of the grooves in a separate other plate of the four plates at each of the corners of the hollow guide section to provide a line of electrically conductive material at each of the corners of the passage through the guide section.

8. A rectangular corrugated waveguide or feedhorn section according to claim 7 wherein in each of the four plates, a first end of each of the grooves is disposed adjacent a first edge of the major exposed surface parallel to a longitudinal axis of a plate, the grooves extending across the major exposed surface such that a second end of the grooves is within the thickness of a plate from a second edge of the major exposed surface opposite the first edge.

9. A rectangular corrugated waveguide or feedhorn section according to claim 8 wherein the side surface bordering on the first edge of the major exposed surface of each plate is engaged with the major exposed surface of a separate one of the four plates in the area between the second edge of the major exposed surface and the second end of the grooves in said major exposed surface.

10. A rectangular corrugated waveguide section according to claim 7, 8 or 9 wherein the major exposed surface of each of the four plates includes a rectangular shape.

11. A rectangular corrugated feedhorn section according to claim 7, 8 or 9 wherein the major exposed surface of each of the four plates comprises a flat frustum shape.

* * * * *